US009045210B2

(12) United States Patent
Hagen

(10) Patent No.: US 9,045,210 B2
(45) Date of Patent: Jun. 2, 2015

(54) UNDERWATER VEHICLE HAVING AN OPTICAL BEAM OPERATING SYSTEM

(71) Applicant: MBDA Deutschland GmbH, Schrobenhausen (DE)

(72) Inventor: Thomas Hagen, Rohrbach/Inn (DE)

(73) Assignee: MBDA Deutschland GmbH, Schrobenhausen (DE)

( * ) Notice: Subject to any disclaimer, the term of this patent is extended or adjusted under 35 U.S.C. 154(b) by 0 days.

(21) Appl. No.: 14/352,908

(22) PCT Filed: Oct. 18, 2012

(86) PCT No.: PCT/DE2012/001011

§ 371 (c)(1),
(2) Date: Apr. 18, 2014

(87) PCT Pub. No.: WO2013/056693

PCT Pub. Date: Apr. 25, 2013

(65) Prior Publication Data

US 2014/0245942 A1 Sep. 4, 2014

(30) Foreign Application Priority Data

Oct. 19, 2011 (DE) ..... 10 2011 116 288

(51) Int. Cl.
*B63G 8/28* (2006.01)
*B63G 8/38* (2006.01)
*F41H 13/00* (2006.01)

(52) U.S. Cl.
CPC .. *B63G 8/28* (2013.01); *B63G 8/38* (2013.01); *F41H 13/005* (2013.01)

(58) Field of Classification Search
USPC ..... 114/316
IPC ..... B63G 8/00,8/28
See application file for complete search history.

(56) References Cited

U.S. PATENT DOCUMENTS

| | | | | |
|---|---|---|---|---|
| 4,021,661 | A * | 5/1977 | Levine | 398/104 |
| 5,677,506 | A * | 10/1997 | Wallin | 89/38 |
| 7,249,567 | B1 | 7/2007 | Wallin | |
| 7,953,326 | B2 * | 5/2011 | Farr et al. | 398/104 |
| 2003/0127558 | A1 * | 7/2003 | Heizmann-Bartels | 244/3.16 |
| 2007/0215030 | A1 | 9/2007 | Scharf et al. | |
| 2008/0029015 | A1 * | 2/2008 | Amidon | 114/328 |

FOREIGN PATENT DOCUMENTS

| | | |
|---|---|---|
| EP | 1 816 761 A2 | 8/2007 |
| GB | 1 507 076 A | 4/1978 |
| GB | 2 351 863 A | 1/2001 |

OTHER PUBLICATIONS

Scott R: "Rays of Light: can shipborne laser weapons deliver?", Jane's International Defence Review, Jane's Information Group, Coulsdon, Surrey, GB, vol. 44, Mar. 1, 2011, XP001560375, pp. 44-49.
International Search Report dated Mar. 20, 2013 w/ English translation (six (6) pages).
German-language Written Opinion Form PCT/ISA/237 dated Mar. 20, 2013 (five (5) pages).

* cited by examiner

*Primary Examiner* — Stephen Avila
(74) *Attorney, Agent, or Firm* — Crowell & Moring LLP

(57) ABSTRACT

An underwater vehicle includes an optical beam operating system having a radiation generator, a radiation emission device, and a radiation transmission device connecting the radiation generator to the radiation emission device. The radiation generator is provided on or in the underwater vehicle. The radiation emission device can be brought to the water surface by the underwater vehicle.

10 Claims, 3 Drawing Sheets

UNDERWATER VEHICLE HAVING AN OPTICAL BEAM OPERATING SYSTEM

TECHNICAL FIELD

Exemplary embodiments of the present invention relate to an underwater vehicle with an optical beam operating system.

BACKGROUND OF THE INVENTION

To date, the classic deployment profile of submarines was the locating and fighting of high-value opposing over-water and underwater targets, in other words enemy ships and submarines. The submarine weapons for this deployment profile are primarily torpedoes that are, without exception, suitable only for fighting sea targets. For fighting on-land targets, submarines currently only have missile systems in which a missile launches hydraulically or pneumatically out of a corresponding container, is then brought to the water surface with boosters, and is started there.

All these known submarine weapons systems are not suited to protect the submarine from direct threats. One of the essential self-defense mechanisms of a submarine in the past was thus its ability to dive deep quickly if necessary and relocate to thereby be able to escape an attack by an adversary. This self-defense strategy, however, does not work for operations in shallow waters. In such deployment scenarios, submarines must have weapons with which they are able to defend themselves particularly against attacks from above, for example from submarine hunting helicopters or submarine-hunting airplanes. This is difficult particularly when an attacking helicopter or an attacking airplane is located in a zenith above the submarine, since this region cannot be cleared with conventional periscopes of the submarines, since their viewing direction is oriented parallel to the water surface, so that generally these threats are detected late.

In the past, there have been submarines constructed with platforms on their top deck to mount machine guns or anti-aircraft guns; however, such weapons could only be used if the submarine had surfaced, and after the surfacing of the submarine, a certain amount of preparation time was required to bring the corresponding weapon into position. In addition, such weapons are not suited for defending against targets in the proximity of the zenith due essentially to the shooting range that is restricted in an upward direction.

Particularly when submarines operate in shallow waters, for example in concealed reconnaissance operations in coastal regions, the submarines must be equipped with self-defense weapons systems that allow the crew to execute rapid defensive measures against above-water attacks, particularly also in the zenith region of the submarine, without having to surface.

In addition, it is also desirable for concealed operations, such as fighting piracy, smuggling, terrorism, or other asymmetrical threats for example, if submarines have deployment means that allow the use of situation-appropriate weapons without these small targets having to be attacked with torpedoes or missiles launched by the submarine, which generally does not seem appropriate and is not reasonable due to cost reasons.

U.S. Pat. No. 7,249,567 B1 discloses an underwater vehicle in which, in the tower of the underwater vehicle, a telescopable lock system is provided through which smaller missiles or reconnaissance drones can be deployed out of the pressurized body of a submarine submerged at periscope depth against close-range threats. This known weapons system can be used reasonably but only preventively against an enemy attack. For a defensive measure for already attacking enemy objects, this known weapons system is not suited due to the preparation times and the slow reaction time.

Directed energy weapons are already currently known, which can fight enemy targets with the energy from laser beams. However, these optical beam operating systems have only been tested for use on land or in aircraft.

SUMMARY OF THE INVENTION

Therefore, exemplary embodiments of present invention are directed to an underwater vehicle with a weapons system, which is rapidly operational for defending the underwater vehicle and which can also be used as an attack weapon from the underwater vehicle against smaller targets on water or on land.

The optical beam operating system of this underwater vehicle according to the invention has a radiation generator, a radiation emission device, and a radiation transmission device linking the radiation generator to the radiation emission device. Accordingly, the radiation generator is provided on or in the underwater vehicle and the radiation emission device can be brought by the underwater vehicle to the water surface. Advantageously, the radiation generator generates high-energy laser beams, preferably in the infrared range.

In this way, when an underwater vehicle is submerged, the radiation energy can be emitted from the radiation emission device located at the water surface without the underwater vehicle having to surface. In addition, such a beam weapon has a low signature, so that the weapon is extremely difficult to detect if at all prior to and after emitting the radiation. The emission of the radiation from the radiation emission device occurs noiselessly so that that the radiation source cannot be located acoustically. An underwater vehicle equipped with such an optical beam operating system thus obtains entirely new self-defense capabilities and new tactical use capabilities. The optical beam operating system provided in the underwater vehicle according to the invention can be deployed without any time lost, in other words directly after detecting a threat. In contrast to this, launch preparations for a missile or bringing it to the water surface by another underwater vehicle require a certain amount of time, for example. This can also be automatically detected by means of sensor systems. Due to the rapid response time, valuable time for position assessment can be gained and the latest possible deployment time, even against rapidly moving targets, can be shifted further into the future.

Since the generation of high-energy radiation and the emission of this radiation occur without major movement of mechanical components and since the high-energy radiation, particularly when high-energy infrared radiation is involved, has a low beam divergence and the emitted beam is visually invisible, the overall signature of the optical beam operating system is extremely low. This is very advantageous particularly in concealed operations, because the concealed operation can thereby be continued, since the underwater vehicle is not detected due to the essentially signature-less optical beam operating system that functions with infrared radiation.

The underwater vehicle according to the invention also has the conventional advantages of optical beam operating systems, such as: shooting capability as long as electric energy is available (known as "deep magazine"); the elimination of ammunition along with the associated supply/disposal logistics; no requirement for ammunition security; the pinpoint, scalable, and directly verifiable effect: and the minimal costs per shot.

An advantageous development of the underwater vehicle according to the invention involves equipping the underwater vehicle with at least one extendable mast and providing the radiation emission device in the region of the free end of the extendable mast. In this embodiment, the radiation emission device can be brought quickly and without any large time delay to the water surface by means of the mast. Also, complete surfacing of the underwater vehicle is not necessary to do so.

Another advantageous development of the underwater vehicle according to the invention involves equipping the underwater vehicle with a detachable daughter vehicle that is connected to the underwater vehicle via a link apparatus, providing the radiation emission device in the daughter vehicle, and providing at least one section of the radiation transmission device in or connected to the link apparatus. In this advantageous embodiment, a major advantage is that the underwater vehicle can remain completely submerged when deploying the optical beam operating system and only the daughter vehicle must be dropped off at the water surface. The mechanical and optoelectronic link between the underwater vehicle and the daughter vehicle floating at the water surface can thus be considerably longer than is the case for the variant with the radiation emission device equipped with an extendable mast. The transmission of the optical beam by the radiation transmission device, for example by optical fibers, which may be integrated in a towing cable forming the mechanical connection device, can also occur at high power over distances of several hundred meters without any problems and without any significant energy loss.

In this variant, it is particularly advantageous if the daughter vehicle is designed as a tow buoy. Thus, the daughter vehicle does not require its own propulsion since it is pulled by the mechanical connection device, for example by the towing cable behind the underwater vehicle.

It is particularly advantageous when the daughter vehicle is equipped with a stabilization platform on which the radiation emission device is arranged. By means of this stabilized platform, the radiation emission device is stabilized against the inherent motion of the floating daughter vehicle so that a reliable alignment capability to the target is made possible. This stabilization can occur by integrating a position-detecting orientation system in the daughter vehicle, wherein for the purposes of position-detecting orientation, the navigation equipment already provided for the general alignment of the beam direction can be used.

In the embodiment with a radiation emission device provided on an extendable mast, it is particularly advantageous if the radiation transmission device runs at least in sections inside the mast.

Accordingly, it is particularly advantageous if the radiation transmission device is formed by an optical conductor or at least has an optical conductor. Such an optical conductor, preferably having optical fibers, can also be carried along as an optical transmission cable inside the periscope when extending the periscope to the water surface and its other end can be connected directly to the radiation generator provided in the underwater vehicle.

Alternatively, at least the part of the radiation transmission device running through the inside of the mast can be formed from an open optical transmission path.

It is particularly advantageous when the radiation generator is provided inside the pressure hull of the underwater vehicle. There it is not only protected against the water pressure caused when diving, but it is also protected against external electromagnetic interference radiation by the pressure hull generally consisting of metal.

It is also particularly advantageous if the radiation emission device is equipped with a targeting device, which is preferably an optical or electro-optical targeting device. In this way, the reconnaissance and targeting of the target can occur directly from the location of the radiation emission device and no second periscope or optronic mast is required from which the target would be observed, even if only from a slightly different angle.

Preferred embodiments of the invention with additional design details and other advantages are described in greater detail and explained in reference to the attached drawings.

DESCRIPTION OF PREFERRED EMBODIMENTS

Figure 1:
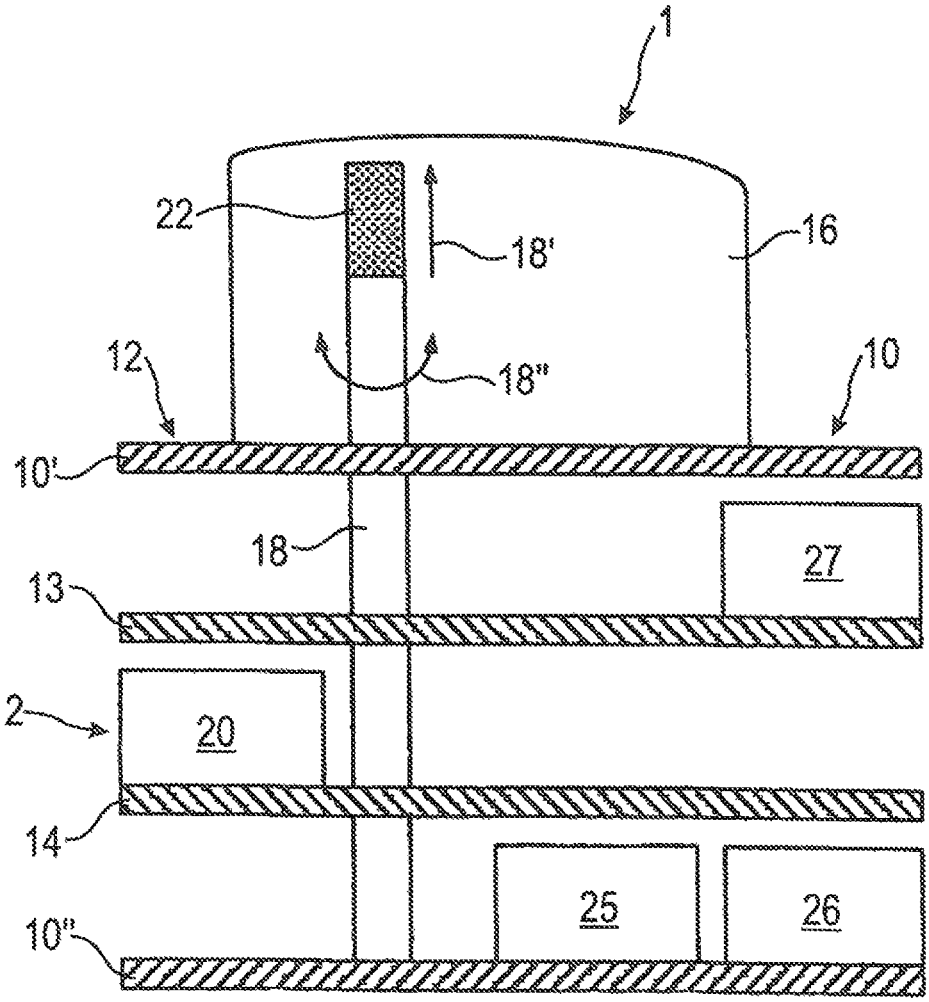
FIG. 1 depicts a schematic longitudinal section profile through the tower section of an underwater vehicle, which according to the invention is equipped with an optical beam operating system.

FIG. 1 depicts a schematic longitudinal section profile of a tower section of underwater vehicle 1. This underwater vehicle 1 is a manned submarine; however, it may also be an unmanned, remote-controlled submarine.

The underwater vehicle is equipped with an exterior wall 10, of which the upper wall 10' and the lower wall 10" of the illustration from FIG. 1 are depicted. Exterior wall 10 adjoins pressure hull 12 of underwater vehicle 1, which is configured to stabilize the pressure prevailing under the water and the pressure forces exerted on the walls of pressure hull 12. There are provided two intermediate decks 13, 14 inside pressure hull 12. On the top side of pressure hull 12 is a tower 16 attached to pressure hull 12. A mast 18 is provided in tower 16 and extends in a known manner into pressure hull 12 of underwater vehicle 1. Mast 18 is telescopically extendable upward out of tower 16, as is typical for submarine masts and is symbolically illustrated by arrow 18'. In addition, mast 18 is pivotable in a conventional manner about its vertical longitudinal axis, as symbolized by double arrow 18".

Underwater vehicle 1 depicted in FIG. 1 is equipped with optical beam operating system 2 further explained below.

Optical beam operating system 2 comprises a radiation generator 20, which in the depicted example is composed of a solid state laser, which emits optical radiation in the infrared wavelength range. This solid state laser is designed as a high-energy laser and is able to emit high-power radiation, which is sufficient for example to produce a focal spot at a distance of several hundred meters to several kilometers, which has temperatures of several hundred degrees Celsius, or in the case of a pulsed laser results in material degradation due to non-thermal interaction.

The output that can be coupled into a single fiber nowadays reaches a level of 10 kW and more. An additional increase in power is possible by multiple single fibers/lasers.

The temperatures in the focus spot formed on the target object by the laser depend among other things on the emitted power and the exposure duration. Temperatures of several hundred degrees Celsius (for example 500° C. to 1,000° C. and even higher) may be reached within a short period, for example after a few seconds.

Such a solid state laser may be designed as a diode-pumped, high-power solid state laser, for example as a fiber laser or disk laser.

The optical beam operation system 2 also has a radiation emission device 22, which is provided in the region of the upper free end of mast 18. A radiation transmission device 24, which will be described in greater detail in conjunction with FIGS. 2 to 5, connects the radiation generator 20 to radiation emission device 22, so that the optical radiation generated in radiation generator 20 can be transmitted by means of radiation transmission device 24 to radiation emission device 22, and be emitted outwardly from there.

A power supply 25 supplies the electrical power required to operate the radiation generator 20. Modern underwater vehicles currently have powerful fuel cell systems for power generation, which are provided in addition to the conventional diesel-electric generators and the batteries charged by these. These power generation systems supply sufficient electric energy to be able to supply a powerful solid-state laser such as radiation generator 20 with electric power of several tens of kilowatts to 100 kW for periods of several minutes. Even underwater vehicles with nuclear-electric propulsion systems are able to provide sufficient electric energy for the required operating period of radiation generator 20.

Such high-energy radiation generators require a cooling device 26 that is also provided in underwater vehicle 1 and is able to provide the cooling while the high-energy radiation generator 20 is being operated. The heat emitted to coolant of cooling device 26 while operating the high-energy radiation generator 20 may be dissipated into the surrounding sea water. This heat dissipation may occur while operating the radiation generator 20 or it may be carried out in a time-delayed manner.

In addition optical beam operating system 2 has a control unit 27, which is also provided inside underwater vehicle 1.

Figure 2:
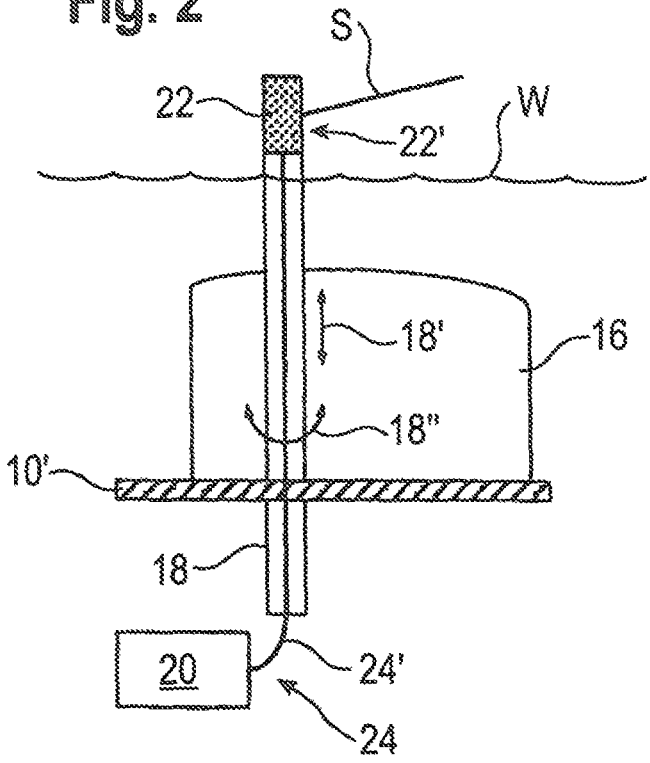
FIG. 2 depicts the underwater vehicle from FIG. 1 with an extended mast in a first embodiment.

FIG. 2 depicts a cutaway of underwater vehicle 1 submerged to periscope depth with an extended mast 18. Mast 18 is extended so far upward that radiation emission device 22 arranged at the upper free end of the mast 18 is located above water surface W. In FIG. 2, one can also see how a high-energy optical beam S, for example an infrared laser beam, is emitted by a beam control system 22' of radiation emission device 22.

In the example of FIG. 2, radiation transmission device 24 is composed of an optical conductor 24' which optically connects radiation generator 20 to radiation emission device 22. The infrared laser radiation generated by radiation generator 20 designed as a solid-state laser is thus routed through optical conductor 24', which has one or more optical wave guides, to radiation emission device 22 and is emitted there as laser radiation S aimed at a potential target.

Figure 3:
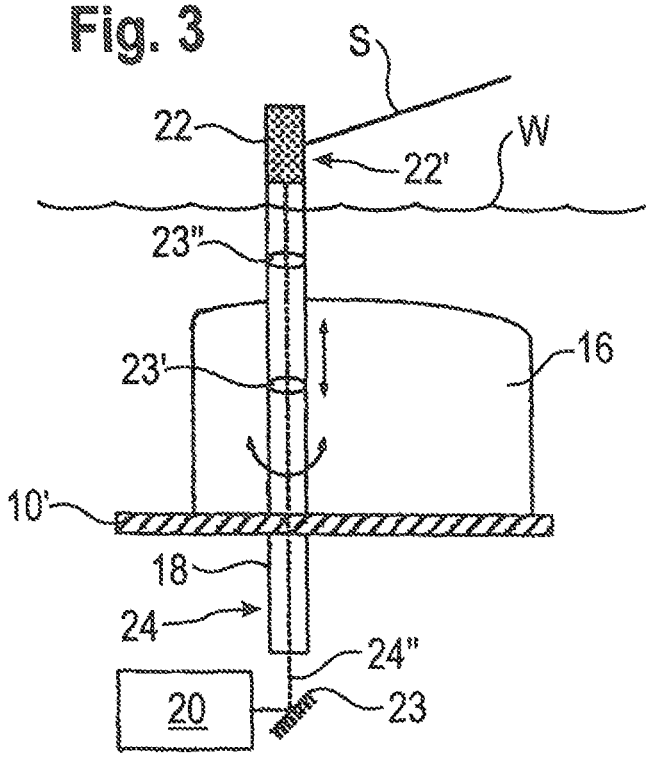
FIG. 3 depicts the underwater vehicle from FIG. 1 with an extended mast in a second embodiment.

FIG. 3 depicts a modified variant, in which radiation transmission device 24 is formed of an open optical transmission segment 24", which is schematically depicted here as a dashed line of the beam direction. In the optical transmission segment, deflection mirrors 23 as well as optical imaging elements 23', 23" are provided, which are formed of lens systems for example. The functioning method of the alternative depicted in FIG. 3 is basically the same as in the embodiment depicted in FIG. 2, with the only difference being that the transmission of the high-energy laser radiation generated by radiation generator 20 to the radiation emission device 22 occurs by way of the open optical transmission path 24".

Figure 4:
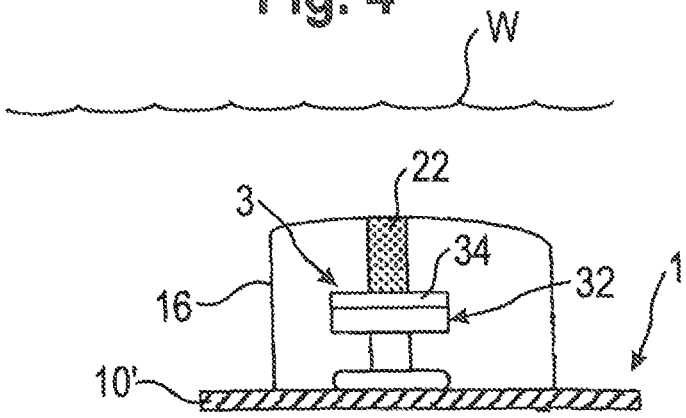
FIG. 4 depicts another variant of the underwater vehicle according to the invention with a daughter vehicle.
Figure 5:
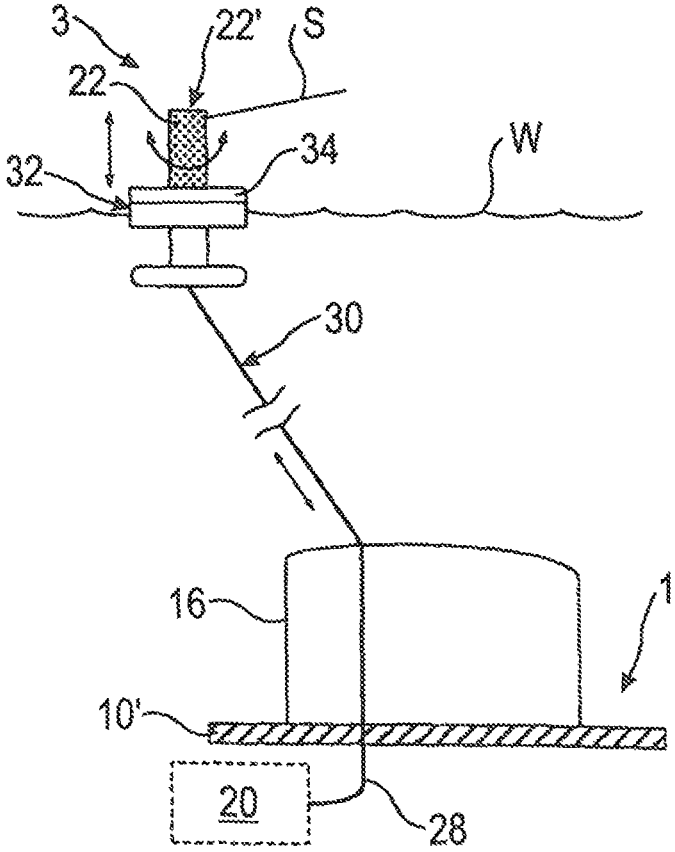
FIG. 5 depicts the underwater vehicle from FIG. 4 with a deployed daughter vehicle.

An alternative embodiment of underwater vehicle 1 according to the invention is depicted in FIG. 4. Here, there is provided in tower 16 a daughter vehicle 3 designed as a tow buoy, the daughter vehicle being able to be dropped off by underwater vehicle 1 and being mechanically connected to underwater vehicle 1 by means of a connection device 30 designed as a towing cable (FIG. 5), so that underwater vehicle 1 can pull daughter vehicle 3 behind it.

Daughter vehicle 3 is equipped with a floating body 32, which ensures that daughter vehicle 3 rises, given a sufficiently long connection apparatus 30, up to water surface W and floats there. A radiation emission device 22 is provided on top of floating body 32, the radiation emission device 22 is mounted on daughter vehicle 3 in such a manner that it can be rotated about a vertical axis, so that optical beam S emitted by it can be aimed at a target. Obviously, beam aiming system 22', as in the first embodiment, can be pivoted about the vertical axis of radiation emission device 22, as well as about a horizontal axis by suitable means.

Radiation emission device 22 or at least its beam aiming system 22' is secured to daughter vehicle 3 by means of a stabilization platform 34 depicted only schematically in the drawings. The stabilization platform 34 ensures that radiation emission device 22 or at least its beam aiming system 22' is stabilized even when daughter vehicle 3 is displaced about all three spatial axes. In this way, precise target aiming is possible, even on a disturbed water surface.

The transmission of the optical radiation from radiation generator 20 to radiation emission device 22 located on the water occurs by means of an optical conductor formed from a radiation transmission device 28, which is integrated in connection apparatus 30 or attached to it, and thereby connected to it.

Radiation generator 20 is provided inside pressure hull 12 of underwater vehicle 1 as in the first embodiment depicted in FIGS. 1 to 3.

The essence of the present invention thus lies in installing an optical beam operating system, for example a laser operating system based on high-power solid-state lasers, for example diode-pumped fiber lasers, on an underwater vehicle to engage soft and semi-hard targets, which serves to provide self-defense of the underwater vehicle against direct threats nearby or to engage targets under the conditions of concealed operations. The underwater vehicle may be a manned or unmanned submarine. The radiation emission device of the beam operating systems is thereby equipped with a beam aiming system, which is either mounted on an extendable optronic mast of the underwater vehicle or on a daughter vehicle 3 connected to underwater vehicle 1. The beam source formed by radiation generator 20 as well as auxiliary devices (cooling, power supply, and control) are arranged in the pressure hull of underwater vehicle 1, wherein the transmission of the optical radiation between radiation generator 20 and beam aiming system 22' of radiation emission device 22 occurs either via an optical conductor (fiber optic cables) or in a directly optical manner in the form of a reverse periscope.

By means of this embodiment of the underwater vehicle according to the invention, a combat effect against above-water targets, airborne targets, and coastal targets can be exercised when the underwater vehicle has submerged to periscope depth. However, the optical beam operating system 2 can also be used in a surfaced state of the underwater vehicle, wherein the advantages of an improved viewing angle due to greater elevation height come into effect.

Basically, it is not required that a stand-alone optronic mast 18 is provided for mounting radiation emission device 22; rather, it is also possible to arrange radiation emission device 22 on a mast carrier serving other purposes of an underwater vehicle, for example on a mast provided for accommodating communication systems. Due to the nature of beam operating system 2 functioning with optical radiation, no effects from it on antenna or radar systems of underwater vehicle 1 are expected. In addition, optical beam operating system 2 according to the invention is largely resistant to electronic disruption measures, even in a partially submerged state, since the sensitive, complex components of beam operating system 2, for example control unit 27, are provided inside pressure hull 12, located under the water, of underwater vehicle 1.

It is obvious that beam operating system 2 is also equipped with suitable precautions that reliably prevent self-radiation with the laser as well as exposing the hull, in addition to other exposed components such as masts and antennas, of underwater vehicle 1 to laser radiation.

The orientation of optical beam S on a target occurs by means of an essentially optical sensor system permanently assigned to optical beam operating system 2. As an alternative or in addition, the control of the beam direction of optical beam S can also be based on reconnaissance or fire control devices, such as radar or optronic masts, some of which are already located on underwater vehicles. In addition, the reconnaissance and fire control devices on-hand are then connected in a suitable manner to control unit 27 of optical beam operating system 2 to exchange data.

As already explained, underwater vehicle 1 may be a manned underwater vehicle (submarine), an unmanned underwater vehicle (UUV), an underwater robot or an underwater drone. In the case of an unmanned underwater vehicle, controlling this vehicle and monitoring its surroundings can be done in a known manner from another vessel, or from land or from the air via remote underwater communication means.

Reference signs in the claims, the description, and the drawings serve only to better understand the invention and shall not restrict the protective scope.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE SIGNS

Referenced are:

1 Underwater vehicle
2 Beam operating system
3 Daughter vehicle
10 External wall
10' Upper wall
10" Lower wall
12 Pressure hull
13 Intermediate deck
14 Intermediate deck
16 Tower
18 Mast
18' Arrow
18" Double-arrow
20 High-energy radiation generator
22 Beam emission device
22' Beam alignment system
23 Deflection mirror
23' Optical amplification element
23" Optical amplification element
24 Radiation transmission device
24' Optical conductor
24" Open optical transmission segment
25 Power supply
26 Cooling device
27 Control unit
28 Radiation transmission device
30 Connection apparatus
32 Floating body
34 Stabilization platform
S Optical beam
W Water surface

The invention claimed is:

1. An underwater vehicle, comprising:
an optical beam operating system configured to generate a beam weapon and which comprises
means for generating a high-power radiation beam;
means for emitting the high-power radiation beam onto a target object as a weapon; and
radiation transmission means for connecting the means for generating to the means for emitting and for transmitting the high-power radiation beam from the means for generating to the means for emitting,
wherein the means for generating is provided on or in the underwater vehicle and
wherein the means for emitting is configured so that it is raisable the water surface by the underwater vehicle.

2. The underwater vehicle of claim 1, further comprising:
at least one extendable mast, wherein the means for emitting is provided in a region of a free end of the extendable mast.

3. The underwater vehicle of claim 1, further comprising:
a daughter vehicle separable from the underwater vehicle and connected to the underwater vehicle via a connection apparatus,
wherein the means for emitting is in the daughter vehicle, and
at least one section of the radiation transmission means is in the connection apparatus or is connected to the connection apparatus.

4. The underwater vehicle of claim 3, wherein the daughter vehicle is a tow buoy.

5. The underwater vehicle of claim 3, wherein the daughter vehicle is includes a stabilization platform on which the radiation emission device is arranged.

6. The underwater vehicle of claim 2, wherein the radiation transmission means runs at least section-wise inside the mast.

7. The underwater vehicle of claim 6, wherein the radiation transmission means is an optical conductor or has at least one optical conductor.

8. The underwater vehicle of claim 6, wherein at least the part of the radiation transmission means running inside the mast is formed of an open optical transmission segment.

9. The underwater vehicle of claim 1, wherein the means for generating is inside a pressure hull of the underwater vehicle.

10. The underwater vehicle of claim 1, wherein the means for emitting includes an optical or electro-optical targeting device.

* * * * *